US006519796B2

(12) United States Patent
Sloot

(10) Patent No.: US 6,519,796 B2
(45) Date of Patent: Feb. 18, 2003

(54) TOTE BAG WITH PILLOW

(75) Inventor: Alexander Sloot, Sugarloaf, PA (US)

(73) Assignee: Printmark Industries, LLC

( * ) Notice: Subject to any disclaimer, the term of this patent is extended or adjusted under 35 U.S.C. 154(b) by 0 days.

(21) Appl. No.: 09/745,508

(22) Filed: Dec. 22, 2000

(65) Prior Publication Data

US 2002/0078506 A1 Jun. 27, 2002

(51) Int. Cl.[7] ..... A47C 27/08
(52) U.S. Cl. ..... 5/636; 5/644; 5/655.3
(58) Field of Search ..... 5/636, 644, 417, 5/419, 655.3; 383/3, 4; 190/1, 125

(56) References Cited

U.S. PATENT DOCUMENTS 3,204,678 A * 9/1965 Worcester ..... 297/DIG. 3
6,217,116 B1 * 4/2001 Sloot ..... 297/220

* cited by examiner

*Primary Examiner*—Lynne H. Browne
*Assistant Examiner*—Fredrick Conley
(74) *Attorney, Agent, or Firm*—St. Onge Steward Johnston & Reens LLC

(57) ABSTRACT

A tote bag having an inflatable device such as a vinyl pillow integrally connected thereto is described. The inflatable is attached to a side of the tote bag so that the bag con be converted for a head rest when the pillow is inflated. The inflatable can be attached along selected sides leaving a side open to form a pocket between the inflatable and the tote bag.

7 Claims, 9 Drawing Sheets

TOTE BAG WITH PILLOW

FIELD OF THE INVENTION

This invention relates to a tote bag that has attached to it a decorative and/or functional inflatable pillow. The pillow can be applied to the inside or outside of the tote bag and when inflated may act as a seat cushion or head pillow.

BACKGROUND OF THE INVENTION

Known in the art are tote bags and carry bags of all description. They are made from a myriad of materials including different types of fabrics such as canvas or nylon, and some are made from plastic materials such as flexible vinyl. Also well known are duffle bags, barrel totes and many others.

Methods for decorating these types of articles would typically be to print on the surface of the products using methods such as screen printing, hand painting, embroidery, vinyl appliques, embossing, heat transfers, foil application and other commonly used methods of embellishment.

These methods of decoration require that the decoration be applied directly to the surface of the article. These decorations are generally only decorations and therefore perform no other useful functions. The article may be decorated on one or both sides.

Also well known in the art are inflatables attached to various fabric products. In my U.S. Pat. No. 5,802,643 I refer to a slipcover, which slips over a lounge chair, and has an inflatable pillow directly sealed to the slipcover. In addition the slipcover may have handles cut into the open end, and when folded it forms a type of a carry bag. The present invention differs from the '643 patent in that with the present invention one starts with an existing tote bag, that does not fit over the back of a lounge chair, and affix an inflatable pillow to the bag.

I have previously obtained two U.S. Pat. Nos. 5,079,788 and 5,251,377 for inflatable appliques for clothing and towels and a method for producing those appliques. These patents describe the production of thermoplastic inflatable appliques applied to clothing and fabrics by sealing applique material parts to the fabric material and cutting away the excess. Because many of the materials and techniques described in those patents are also useful in conjunction with the teachings herein disclosed, they are incorporated by reference.

SUMMARY OF THE INVENTION

With a carry bag in accordance with the invention a quick, simple, inflatable pillow is formed onto a fabric or plastic tote bag or other type of carry bag. Upon arrival at a sporting event the person will have a handy inflatable sports cushion. The inflatable may be decorative in nature, and can be inflated to form a comfortable seating cushion or head pillow.

Accordingly, it is an object of the present invention to provide a pre-decorated inflatable panel as a permanently attached pillow, which can be easily applied to various types of carry bags. Still another object of the invention is to provide a pillow which itself may form an extra pocket on the carry bag. Still another object of the invention is to provide an inflatable cushion for user comfort whether the user be seated or lying down.

Still another object of the invention is to provide a pre-decorated inflatable panel as a permanently attached pillow where the perimeter of the pillow can have a variety of decorative shapes. The shape may conform to a product being advertised on the carry bag, or it may conform to the shape of the artwork on the pillow.

It is still another object of the invention to provide a pre-decorated inflatable panel as a permanently attached pillow where during the manufacturing process, more than two layers of material can be used to make the pillow, the extra layer being an independently printed layer which is laminated to the top pillow layer for ease of printing.

Still another object of the invention is to provide a pre-decorated inflatable panel as a permanently attached pillow where the pillow is not sealed to the bag on all sides, but where a shaped portion extends away from the pillow to further enhance the decorative features of the pillow.

Yet another object of the invention is to provide a pre-decorated inflatable panel as a permanently attached pillow where more than one pillow is attached to the bag for additional pillow comfort such as two pillows back to back on the same bag panel or one each side on opposite panels.

Another object of the invention is to provide a pre-decorated inflatable panel for a carry bag as a permanently attached pillow where the pillow can be attached on the inside or to the outside of the bag.

Yet another object of the invention is to provide a pre-decorated inflatable panel as a permanently attached pillow for a tote bag, where the tote bag itself is made of a thermoplastic material such as vinyl. Only one layer of material needs be added to the tote bag, because one side of the vinyl bag will form the second air impervious layer to form an inflatable pillow.

These and other objectives are achieved by utilizing various air-impervious flexible thermoplastic materials to form inflatable pillows to adorn the tote bags. Thermoplastic materials such as polyethylene, nylon, urethane, rubber and others may be used for the inflatable pillows. However a preferred material is a pinhole-free vinyl or a soft urethane. These materials will generally have a thickness in the range of 0.005" to 0.020". R.F. sealing is the most preferred manufacturing method to use to bond the two layers together to form the pillow, although heat, sonic sealing, vulcanizing and other methods may be used.

Urethane is R.F. sealable as is vinyl, and urethane has excellent airtight properties. (Urethane is one of the primary materials used for the air bladders of footballs, soccer balls, basketballs and others.) It is preferable for the vinyl to be "pinhole free", but this is not necessarily essential. (Pinhole free vinyl costs only slightly more than a standard vinyl.) The preferred thickness of the vinyl or urethane will be in the 0.005" to 0.020" range. When utilizing vinyl, the thicker the material, the more air impervious it will be. Thus pinhole free material is not necessarily essential for a successful product if the vinyl used is in the thicker range such as more than 0.012" in thickness. Furthermore, when a pre-printed sheet is laminated to a top layer, an almost perfect airtight barrier is created to reduce the need for a specific pinhole free material.

In one embodiment in accordance with the invention, a first layer of vinyl bearing a decorative printing on one side, will overlay a second vinyl layer which forms the inside of the pillow. The first layer may be a plain vinyl, which is printed, or a vinyl that is reflective, or glows in the dark, or has a holographic image or has some other background of an interesting nature. It may also be a flocked vinyl for a soft feel and appearance. It may also be a vinyl with a cloth laminated to it to give it a fabric-type surface.

With a decorative pillow added to a tote bag, in accordance with the invention, a variety of shapes can be achieved for the pillow. It can be made in an economic manner and made available with attractive appearances including graphics, reflective features, glow materials or other enhancements as may become desirable.

The preferred article onto which to attach an inflatable pillow is a canvas tote bag, a nylon tote bag, or a vinyl tote bag. However other types of bags may be used where applying an inflatable pillow is functional such as large duffel bags, knapsacks, rugsacks and others.

The invention and its particular features will become more apparent from the following detailed description considered with reference to the accompanying drawings.

DETAILED DESCRIPTION OF THE DRAWINGS

Figure 1:
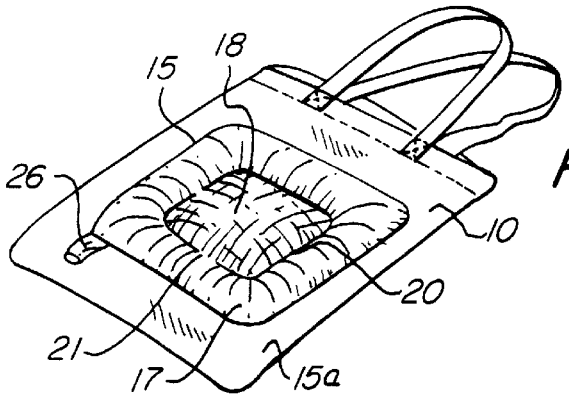
FIG. 1 is a perspective view of one embodiment of an inflatable cushion attached to a tote bag in accordance with the invention.

With reference to FIG. 1 a tote bag 10 in accordance with the present invention is shown with an inflatable 15, such as a rectangular inflatable pillow, is attached to an outside surface 15*a* of the bag 10. In this depiction, a stem valve 26 is used as the means to inflate air into the pillow 15 and then be sealed closed. The valve stem 26 is created while the pillow 15 is being formed directly on the bag 10. By placing an insulating material such as a strip of Teflon or release paper on the tote bag 10 at the valve stem area, between opposing layers of vinyl that make the inflatable pillow 15 the valve can be made at the same time the layers are sealed together and to bag 10. The insulating or release paper assures that the stem 26 will not adhere to bag 10, even though the inflatable 15 is made to adhere.

Areas of "quilting" made with one or more inner depression patterns, such as 20, are also shown in FIG. 1. This quilting pattern serves to anchor part of the inflatable 15 to bag 10. The quilting pattern further prevents the pillow 15 from totally ballooning up when it is inflated, and thus provide a more comfortable flatter appearance. Openings 21 in the quilting pattern 20 allow air to get to all areas of the pillow 15 so that there are no independent un-inflated chambers. It is understood, however, that if un-inflated areas are desired, these can be made by sealing off certain areas so that air cannot get into these areas.

Area 17 shows an outer inflated area of the pillow, and area 18 shows an inner inflated area. Of course there can be more than one depression pattern 20, creating more than two inflated areas within a pillow for a more intricate quilting effect.

Figure 2:
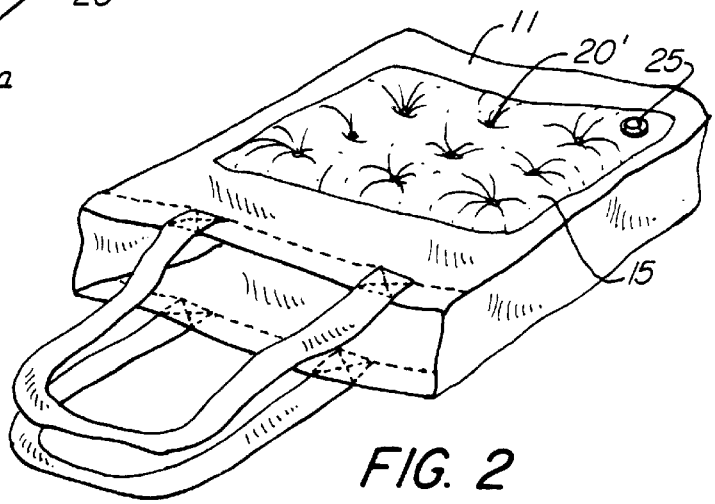
FIG. 2 is a side perspective view of another embodiment of the inflatable cushion attached to a gusseted tote bag in accordance with the invention.
Figure 3:
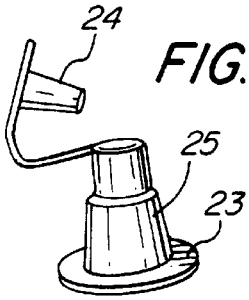
FIG. 3 is a perspective view of a standard, molded, soft recessible PVC valve.

A gusseted tote bag 11 with its attached inflatable pillow 15, but with a different quilting configuration is depicted in FIG. 2. Here small circular depression dots 20' create a uniform rounded quilting effect. In this drawing the pillow uses a conventional molded soft plastic recessible valve 25 as shown in FIG. 3. This valve may appear on the outside of the pillow as shown, or a hole may be pre-cut into the tote bag 11, so that the valve 25 appears on the underside of the pillow or actually projects into the inside of the tote bag 11.

Figure 4:
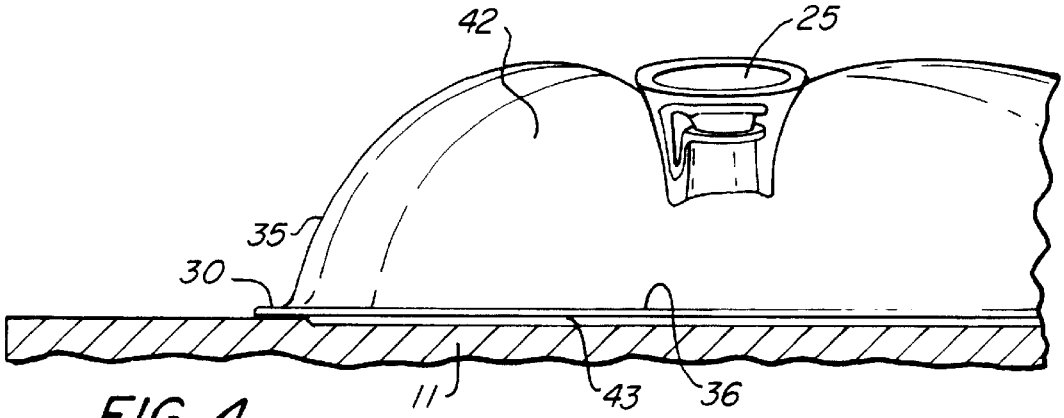
FIG. 4 is a partial side sectional view of a portion of the inflated pillow on a tote bag, showing the valve in its recessed position.

FIG. 3 shows a standard molded soft plastic recessible valve 25, which valves are readily available in the industry. The valve comprises a base 23, which is sealed to one of the layers of vinyl, which forms the pillow. This is done in a first step before a pillow 15 is formed onto tote bag 10 or 11. Plug 24 serves to close the valve 25 and thus prevent air from exiting the pillow 15. FIG. 4 shows the valve 25 in its recessed position. FIG. 4 further illustrates the attachment of the pillow 15 to the tote bag 11 by joining the opposing vinyl layers 36 and 37, which are sealed together at edge 30. At edge 30 the vinyl material of the lower layer 36 is made to penetrate the interstices of the fabric material that makes up the tote bag 11 for attachment of the pillow 15 to the tote bag 11. Within the perimeter of edge 30 and below pillow 15 there is a gap 43 that can be used to form a pocket.

Figure 5:
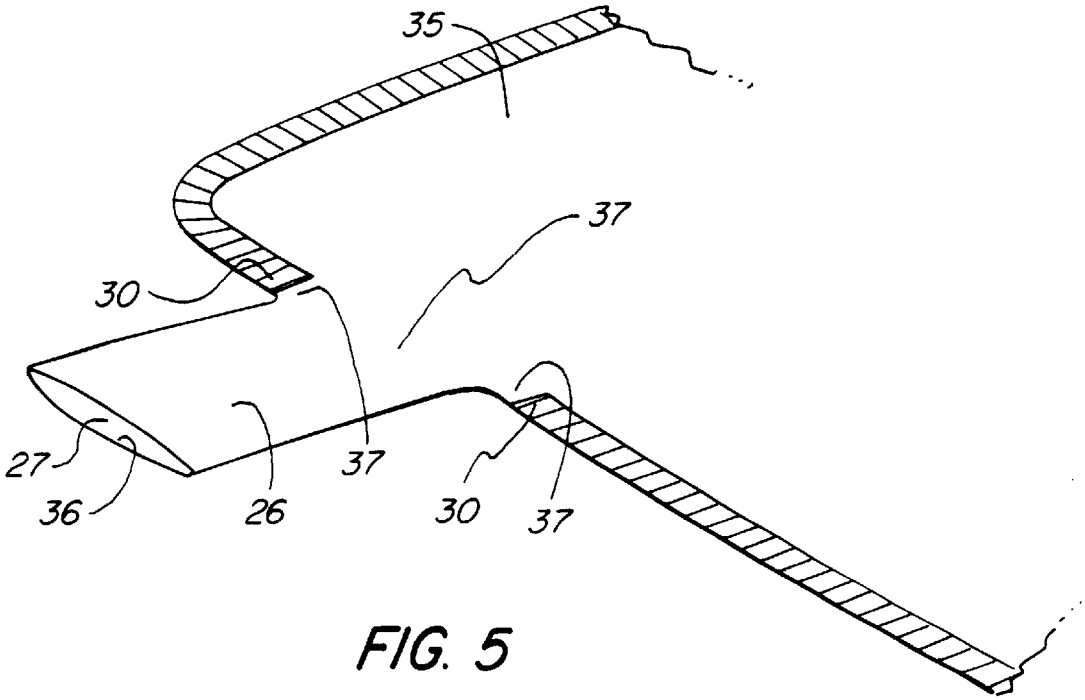
FIG. 5 is a perspective view of a portion of the inflatable pillow showing a stem-valve for inflation of the pillow.

FIG. 5 shows a stem valve 26 after it is formed as part of an inflatable pillow 15. Note that sealing edge 30 holds the pillow onto bag 11, but the sealing edge 30 is interrupted at 37 where stem 26 protrudes. The lower vinyl layer 36, the upper vinyl layer 37 form the stem 26 and define a valve opening 27 through which air is added to inflate the pillow 15.

Figure 6:
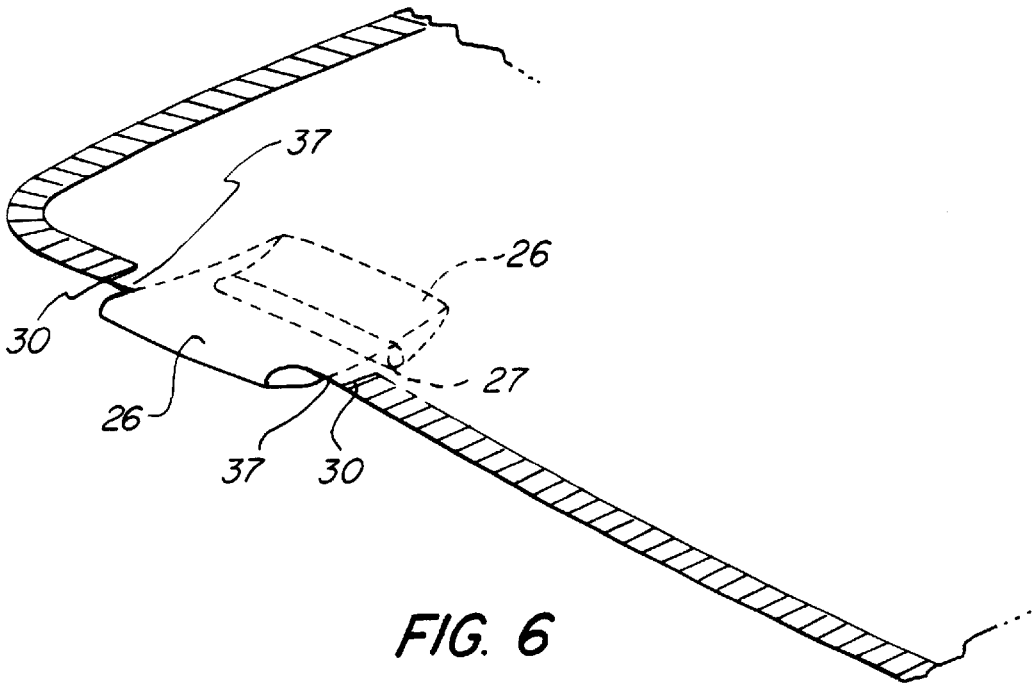
FIG. 6 is a perspective view of a multiple folded stem-valve to make it airtight.

After inflation, the stem 26 can, as shown in FIG. 6, be folded in half, and slid under the pillow 15 into the open or unsealed area 37. The pressure of the inflated pillow 15, and the fact that opening 37 is quite tight, will hold the stem 26 in place and prevent it from unfolding and allowing air to escape.

Figure 7:
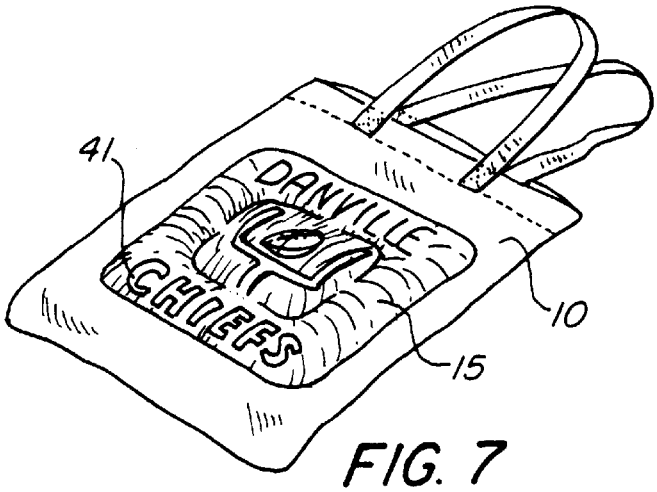
FIG. 7 is a perspective view of a tote bag with a graphically decorated inflatable pillow.

FIG. 7 indicates how tote bag 10 with an inflatable pillow 15 will appear when the pillow 15 is graphically printed at 41 with an advertisement, logo or other design such as a sports team.

Figure 8A:
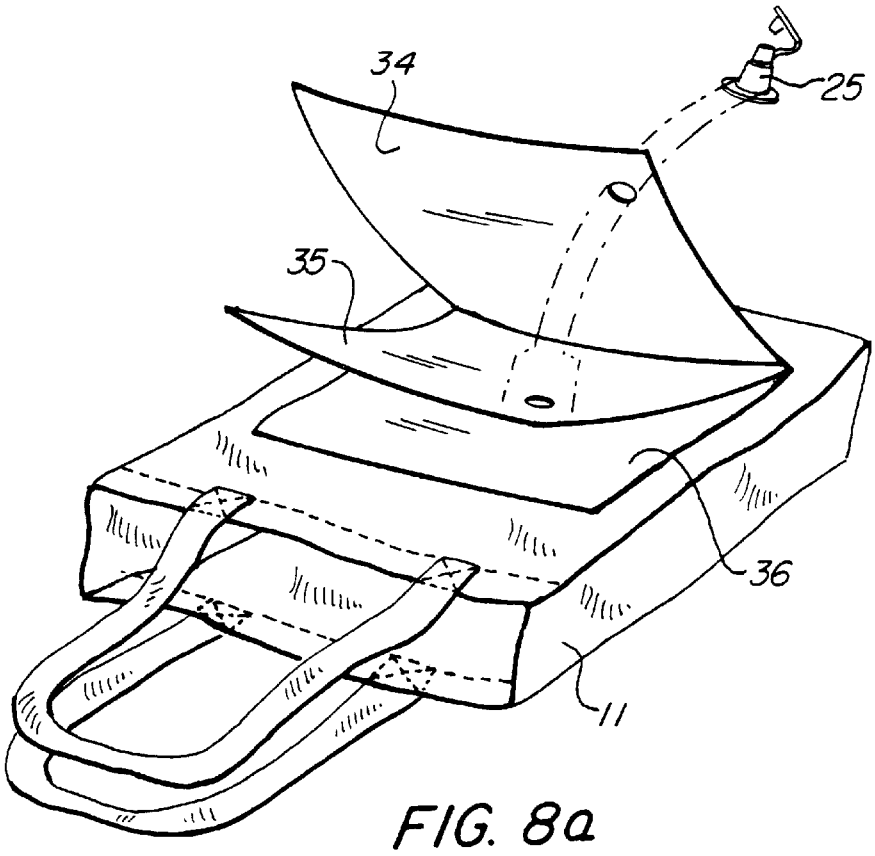
FIG. 8*a* is a perspective view of a tote bag and its layer sections, which make up the inflatable pillow.
Figure 8B:
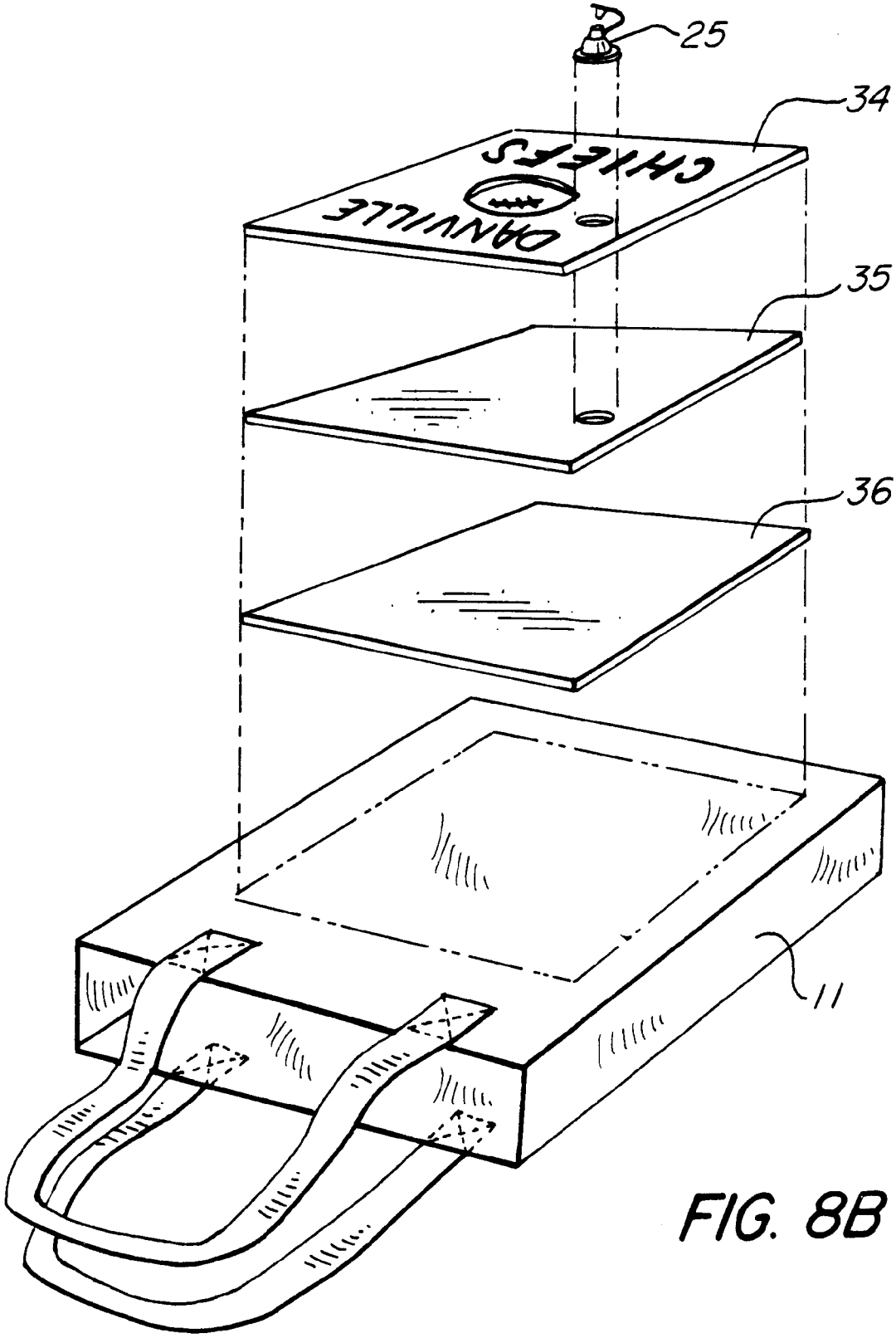
FIG. 8*b* is an exploded perspective view of the tote bag shown in FIG. 8*a*.

Three vinyl layers, 34, 35, 36 make up a pillow 15 as indicated in perspective in FIG. 8*a* and in an exploded view in FIG. 8*b*. Two layers are generally sufficient, but for ease of production, one may want to print on a more ink receptive outer vinyl layer 34 which is laminated to layer 35 so that together these form a top layer for the pillow 15. Then when this pair of layers, 34 and 35, is perimeter sealed to lower layer 36, an inflatable pillow 15 is formed. Any type of valve, such as valve 25, can be used to inflate the pillow.

Figure 9:
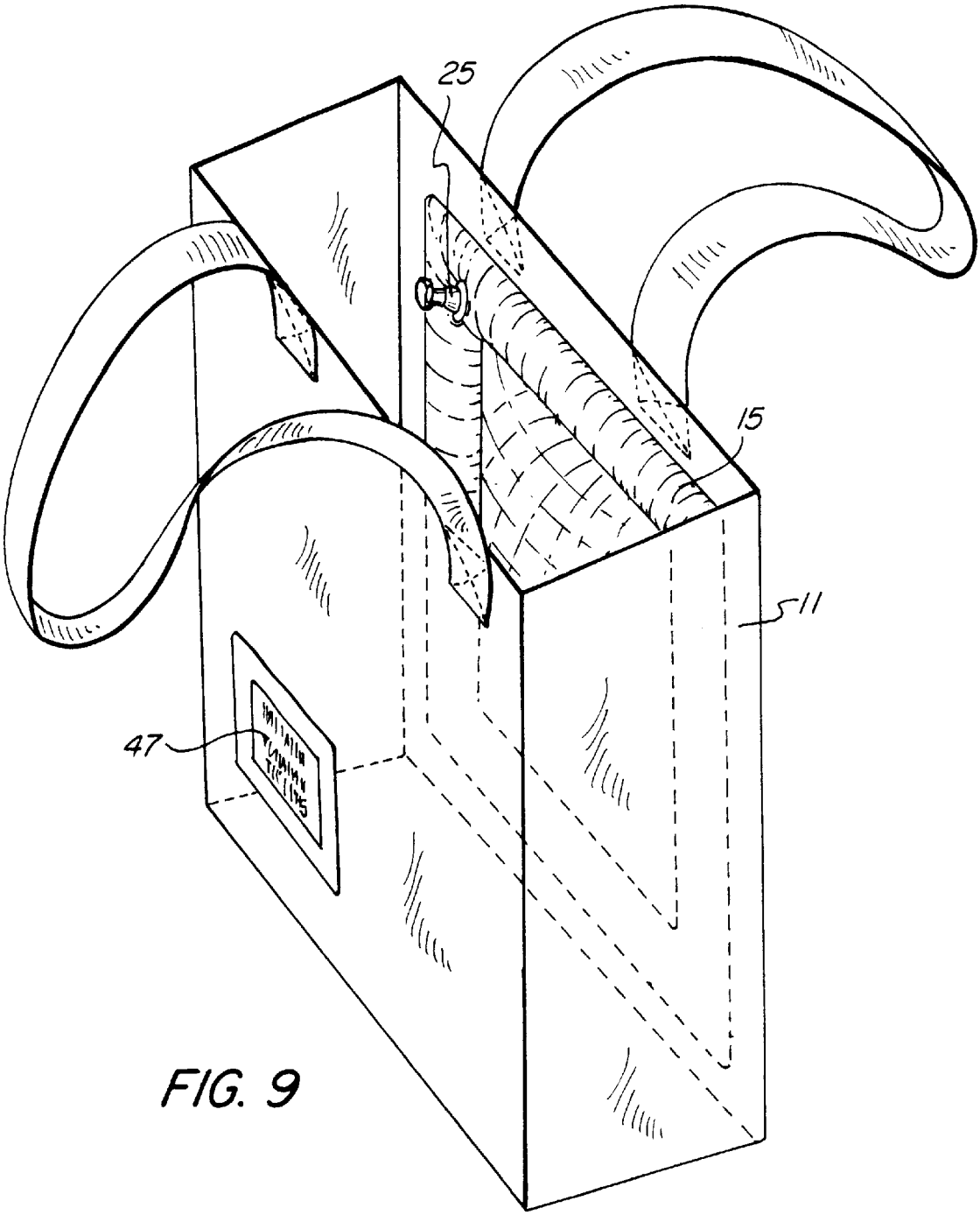
FIG. 9 is a perspective view of a tote bag in accordance with the invention with an inflated pillow attached to the inside, and a decoration such as an applique on the opposite side.

The pillow can easily be attached to the inside of the tote bag 11 as shown in FIG. 9. In this case the valve 25 can be installed through the fabric layer of the bag 11 and onto the inner surface layer of pillow 15, this construction avoids a visual interference with the outer appearance of pillow 15. A vinyl applique, embroidery, screen print, iron-on patch or other decoration 47 may be placed on either side of the tote bag. For least interference with pillow 15, it is preferable that the decoration 47 be applied to the side opposite to that of pillow 15.

Figure 10:
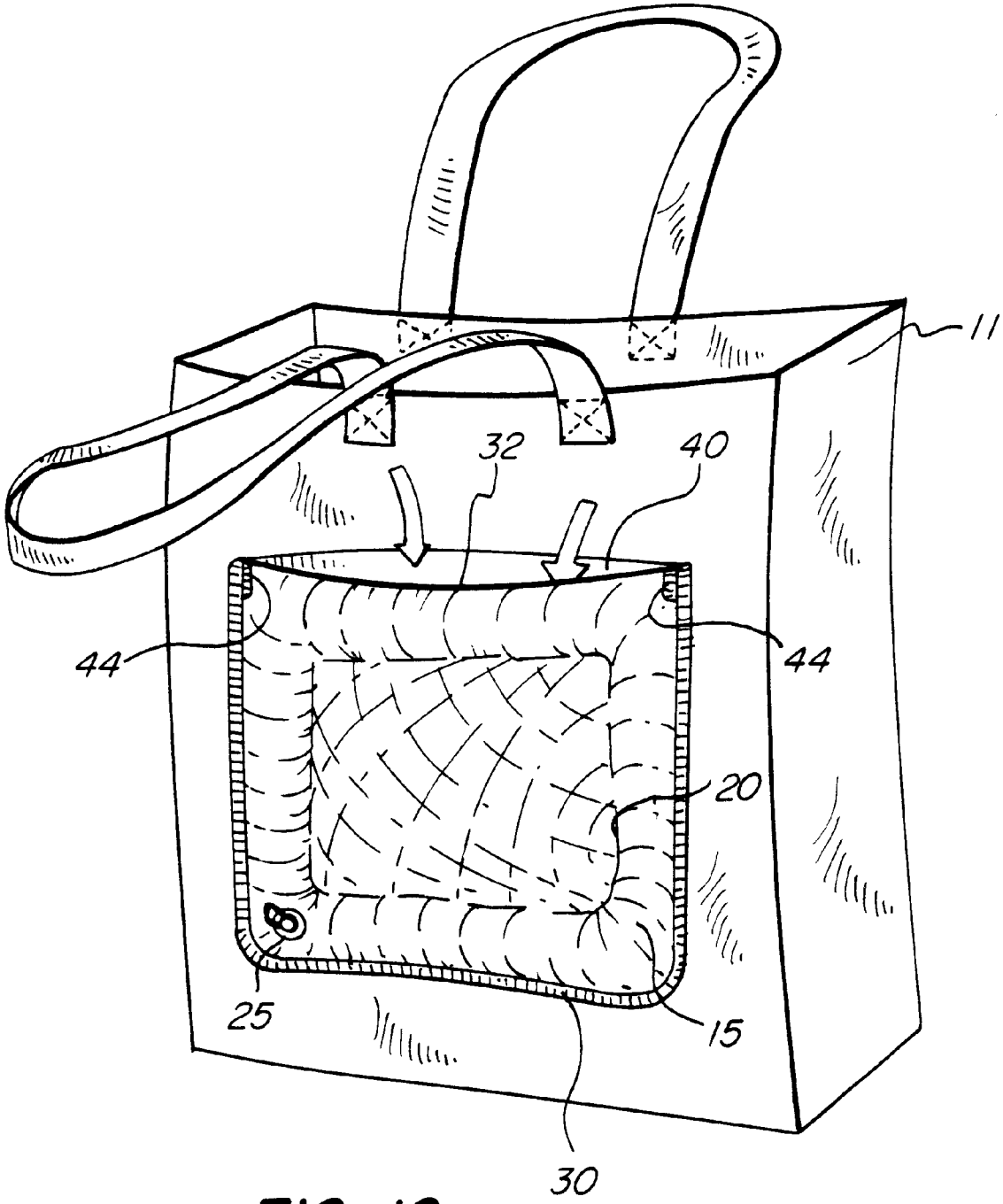
FIG. 10 is a perspective view of a tote bag in accordance with the invention with an inflatable pillow, where the pillow is attached on three sides leaving one side open to form a pocket.

Tote bag 11 may have pillow 15 attached to it with three sides only. FIG. 10 shows this configuration so that an additional pocket 40 can be formed on the outside of the tote bag. By attaching only on three sides or with a partial perimeter attachment in case of a non-rectangular shape, an opening 40 allows for items to be accommodated in the pocket. Items are best accommodated when the pillow is not yet inflated. When one is carrying the tote bag, the pillow would normally be in a deflated state.

This additional pocket 40 further adds to the utility of tote bag 11. The sealing line 30 appears all around pillow 15 in order to make it airtight. But where the pillow 15 attaches to the bag 11, sealing line 30 will be thicker in width. Where the pillow is used to make a pocket 40 with an opening 40, the sealing edge 30 is not attached to bag 11. At the two top corners where the opening 40 to the pocket appears, the seal line may even have an additional reinforcement 44. Note that to preserve the integrity of pocket 40 the inner embossing lines 20 between the vinyl layers that form the pillow cannot be attached to tote bag 11. To accomplish this a separation sheet of Teflon or other non-stick material can be placed on the tote bag 11, under the pillow forming layers, when pillow 15 is being sealed to it. The Teflon will appear below the areas of the inner embossing lines 20, as well as below the layers at the opening of the pocket area 40. This will allow the vinyl layers 35, 36 and 37 to bond to each other at the opening as well as at the inner depression points, but they will not seal to the tote bag wherever the Teflon or separation sheet is present. The Teflon sheet is removed after sealing.

Alternatively pillow 15 can be made independent of the tote bag 11 in a first step, and then the finished pillow can be sealed along its three sides to the tote bag in a second step.

Figure 11:
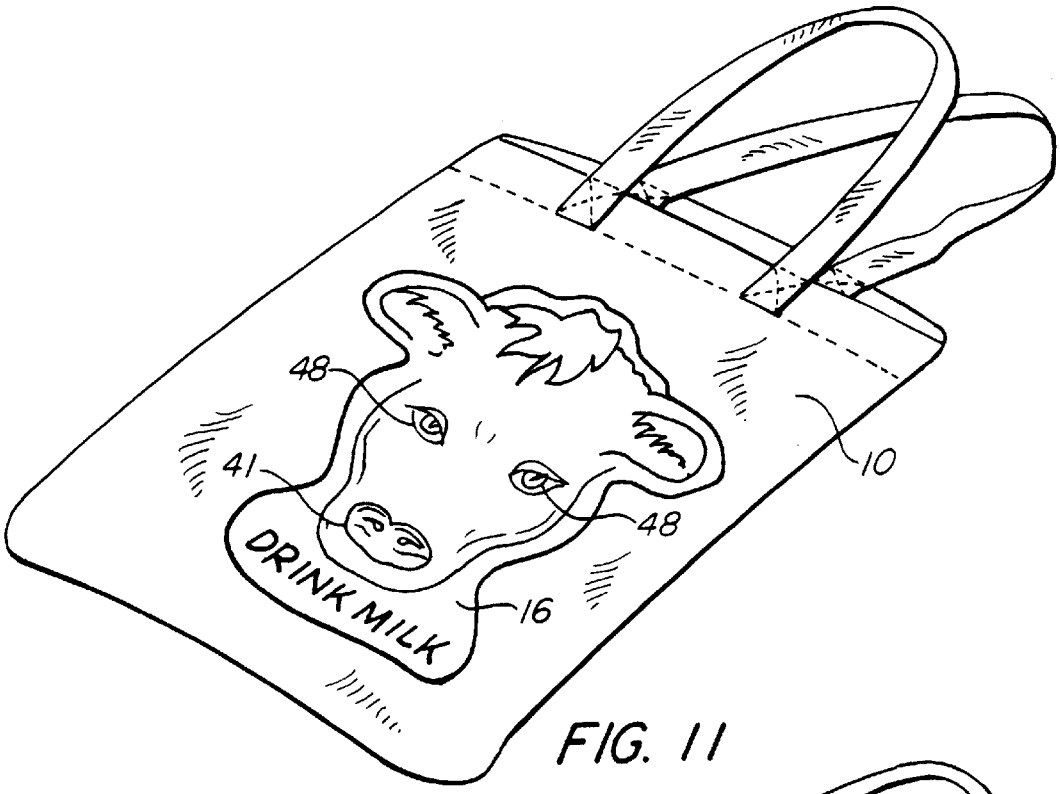
FIG. 11 is a top perspective view of a tote bag with a shaped inflatable pillow, where the shape conforms to a graphic design.

FIG. 11 shows a shaped pillow 16, which is attached to tote bag 10. The pillow can be of any shape, but it is obviously preferable that it be large and chunky in nature, so as to provide a pillow of comfort and adequate size. Quilting impressions 48 (previously indicated as 20 in FIG. 1, can now appear as part of the design such as within the eyes in design 41. These impression areas 48 help to provide a more comfortable cushion in that they prevent the inflatable from ballooning.

Figure 12:
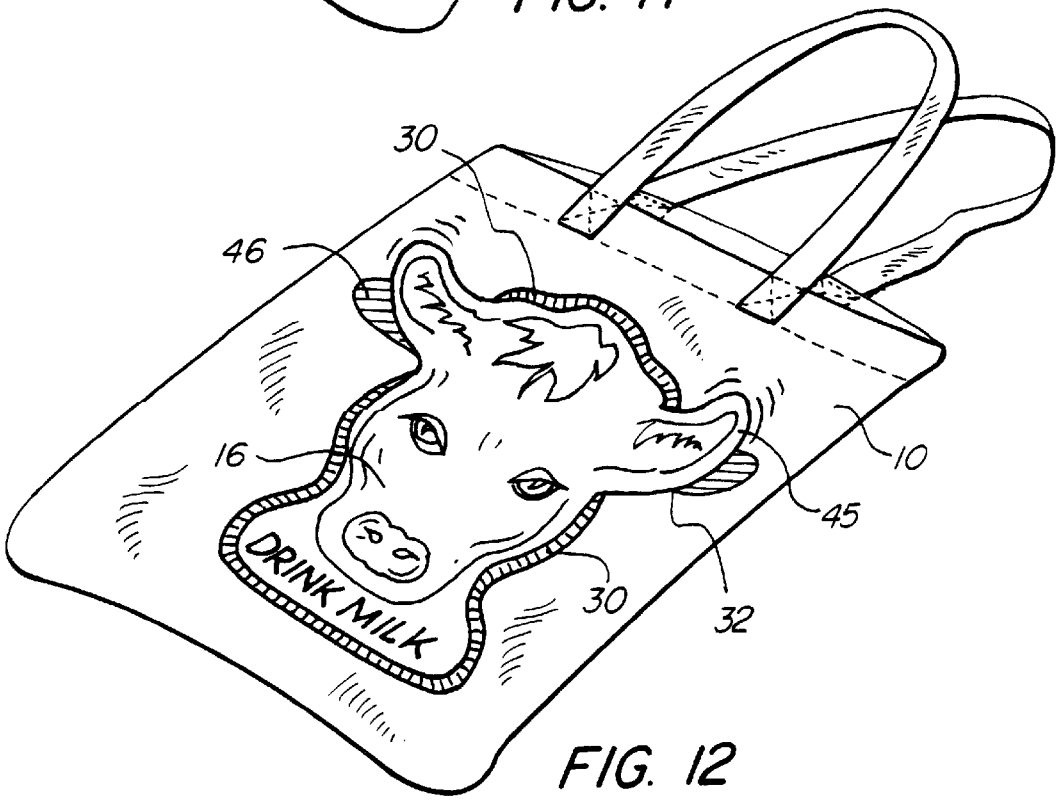
FIG. 12 is a top view of a tote bag with a shaped inflatable pillow, conforming to a graphic design, in which not all of the pillow perimeter is attached to the tote bag.

The design in FIG. 12 is similar to FIG. 11, but in this case not all of the inflatable is sealed to tote bag 10. Areas 45, which are the ears of the cow, are free and unattached. 46 shows the shadow caused (shown as an exaggeration) to better depict the meaning of the drawing. Once again, while sealing line 30 goes around the entire inflatable 16, in the areas where it attaches the inflatable to the tote bag, it may be made slightly thicker for better adherence. 32 represents the part of the sealing edge which is not attached to the Bag.

Figure 13:
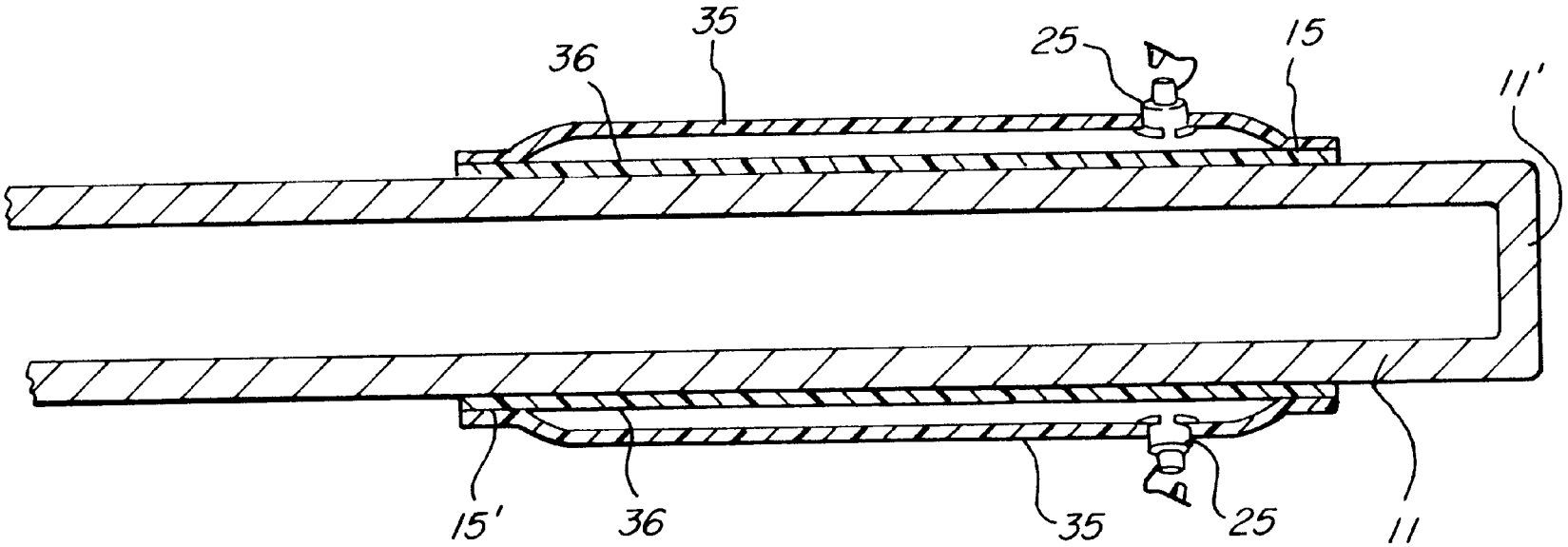
FIG. 13 is a side sectional view of a tote bag with two pillows attached, one on each side.

FIG. 13 shows tote bag 11 with two pillows 15 and 15' attached. They may be attached on either side i.e. the inside or the outside of the bag. Two pillows are useful if the user desires a greater degree of comfort. If attached to both outside areas of the tote bag, then two different types of graphics may be displayed. The gusseted base of the tote bag 11 is shown as 11'.

Figure 14:
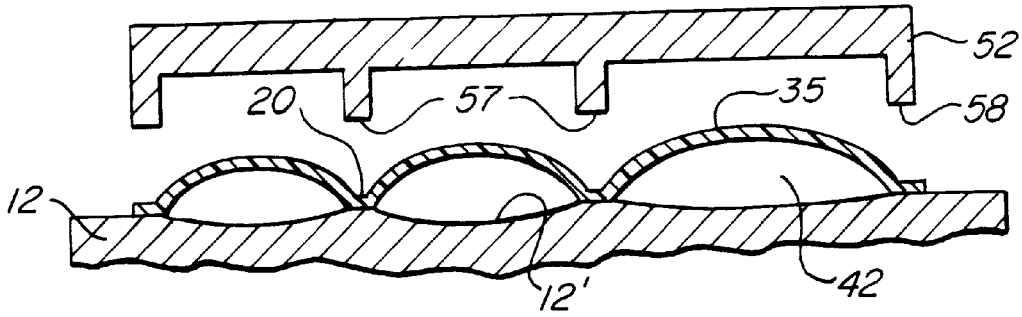
FIG. 14 is a side sectional view of a sealing die for sealing a pre-cut sheet of vinyl sheet to make a pillow in accordance with the invention and wherein the cut vinyl sheet becomes part of the pillow attached to a vinyl tote bag, and wherein the die has inner sealing elements to create embossing areas for a quilted effect within the pillow.

In FIG. 14 the die used to make the inflatable pillow has a flat sealing edge. This is useful in two instances:

Firstly, when using a tote bag 12 made of vinyl, only one additional layer needs to be sealed to the tote bag in order to make an inflatable pillow. Upper layer 35 may be printed or if left unprinted, it can be combined with additional printed layer 34. One or both of these will be pre-cut to the exact desired size, usually by means of die-cutting. These are then placed on tote bag 12, and the flat edged die 52 is brought down on the bonding machine to bond the layers to the vinyl tote bag 12 to form the inflatable pillow. The valve can be on the inside of the bag, or on the outside of the pillow. Note that with a flat edged die 52, the inner impression extensions 57, which provide the quilted effect, are of the same height as the outer sealing edge extensions 58. The vinyl tote bag 12 forms the lower layer of the pillow. When the pillow is inflated, the tote bag 12 will compress inwards slightly as shown at 12'.

Secondly, the use of a flat edged die such as die 52 in FIG. 14 is useful when one is making the inflatable pillow out of a cloth covered vinyl or a reinforced vinyl. In both of these cases, the vinyl, because of the cloth bonded to it, will not "tear-seal", i.e. seal and cut in one operation. Thus the cloth/vinyl combination will need to first be die-cut to size or shape, and then sealed to the tote bag with flat edged die 52. This needs to be done whether the tote bag is made of cloth or vinyl.

Figure 15:
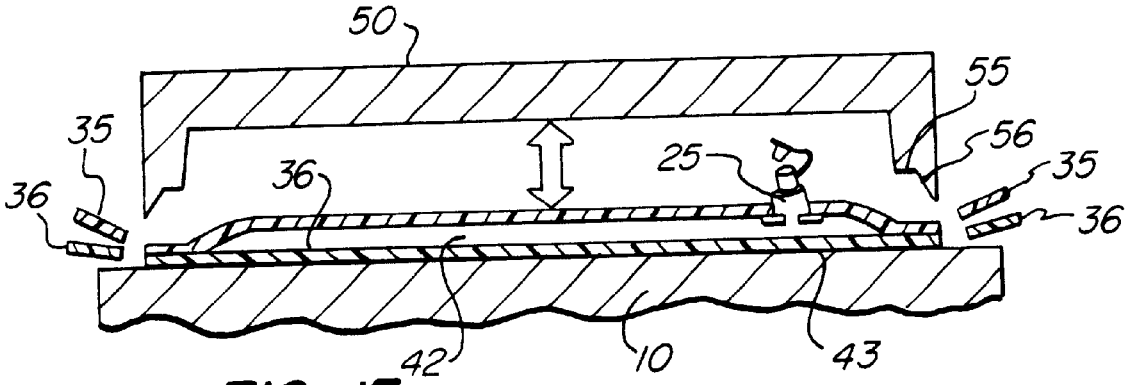
FIG. 15 is a side sectional view of a sealing die, which seals the vinyl materials to a fabric bag and wherein the die seals and cuts to form the vinyl pillow in one operation.

FIG. 15 in accordance with the invention is a side sectional view of a sealing die. Sealing die 50 depicts a sealing die with no inner impression lines. Shown as part of the die is a sealing edge 55 and a cutting edge 56. When utilizing the preferred materials vinyl or urethane for the inflatable, these materials with top layer 35 and lower layer 36 enable cutting and sealing in one operation while the inflatable is being formed and being attached to tote bag 10. Valve 25 is shown on the top of the pillow in this depiction.

Figure 16:
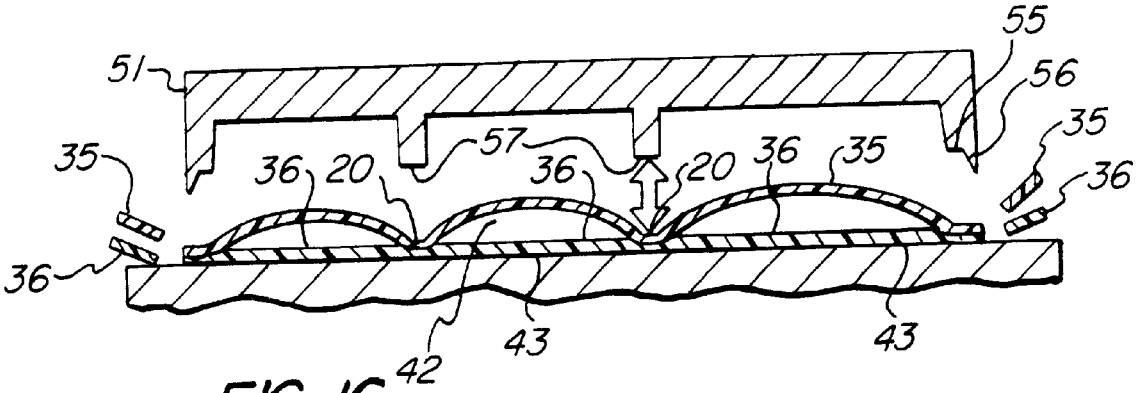
FIG. 16 is a side sectional view of a sealing die, which seals the vinyl materials to a fabric bag, wherein the die seals and cuts the vinyl pillow formed in one operation, and the die has inner sealing elements to produce embossing areas to create a quilted effect within the pillow

Sealing die 51 in FIG. 16 shows a die as above with seal line 55 and cutting edge 56, but with inner impression extensions 57. These impressions will form the quilting effects as indicated at 20 and 48 above. Not shown here but easy to implement is a valve 25 which may be passed through a pre-cut hole in the tote bag 10. This pre-cutting and directing of the valve through the fabric might be advantageous if one desires the pillow to be on the outside of the tote bag, but where one does not want the valve to interfere with any graphics on the pillow.

For manufacturing, a printed sheet 34 may be laminated to a top layer 35, or top layer 35 may itself be printed. The combination of these top layers or 35 alone will be placed over lower layer 36 in position onto a tote bag which has already been placed into an R.F. Sealing machine. The tote bag is placed on an anvil so that the back fabric part of the tote bag is not directly under the front fabric portion. The head of the machine comes down. Dies 50 or 51 will have previously been mounted into the head of the machine. The R.F. sealing process will cause the layers to be sealed together, and all excess material will automatically cut away. The die descends onto the materials, and seals the layers together around their perimeters, and embosses any inner seal lines if these are designed into the die. These lines would form the previously described quilting effect at 20 or 48.

However it is also understood that the inflatable pillow may be made separately and not formed directly on the tote bag. (This is referred to in FIG. 10 above.) If the pillow is made with a wide sealing edge, then this pre-made pillow may be sewn onto the bag. It may also be glued on, sealed on with heat, attached by velcro, attached by a mechanical fastener or affixed in some other manner so as to form an inflatable pillow/carry bag in one.

Having thus explained and described several embodiments for forming a tote bag with an inflatable pillow the advantages and objects of the invention can be understood. Variations from the invention can be made withut departing from the scope of the invention as defined by the following claims.

What is claimed is:

1. A manual carry all, comprising:

a tote bag defining a storage space, said tote bag comprising at least one outer side wall, the outer side wall having an inner surface at least partially defining the storage space and an outer surface opposite the inner surface;

an inflatable vinyl pillow, said inflatable having an inner layer and an outer layer sealed to one another along an outer perimeter and to the outer surface of the outer side wall of said tote bag along at least a portion of said perimeter;

a valve attached to the inflatable to enable a manual inflation of the inflatable; and wherein said vinyl inflatable is shaped to have multiple sides, with at least three side of the inflatable being affixed to the outer surface of the outer side wall of said tote bag and with at least one side being free and unattached to the outer surface of the outer side wall of said tote bag so as to form a pocket between the vinyl inflatable and the tote bag.

2. The carry all as claimed in claim 1 wherein said vinyl inflatable is attached to the outer surface of the outer side wall of said tote bag along a continuous partial perimeter of the inflatable.

3. The carry all as claimed in claim 1 wherein said valve is connected to the inflatable through the inner surface and the outer surface of the outer side wall of said tote bag.

4. The carry all as claimed in claim 1 wherein said inner and outer vinyl layers are selectively attached to each other within said perimeter so as to form a quilted shape upon inflation of the inflatable.

5. The carry all as claimed in claim 1 and further including an additional graphically decorated layer laminated to the outer layer of the vinyl inflatable.

6. The carry all as claimed in claim 1 wherein the inflatable has a decorative shape conforming to a graphic decoration on said outer layer.

7. The carry all as claimed in claim 1 wherein said carry all comprises two outer side walls and two inflatables, one inflatable attached to the outer surface of each of the two outer side walls of said tote bag.

* * * * *